US005499585A

United States Patent [19]

Vanderminden, Sr.

[11] Patent Number: 5,499,585

[45] Date of Patent: Mar. 19, 1996

[54] TRESTLE TABLE

[75] Inventor: Robert D. Vanderminden, Sr., Granville, N.Y.

[73] Assignee: Telescope Casual Furniture Co., Granville, N.Y.

[21] Appl. No.: 266,012

[22] Filed: May 27, 1994

[51] Int. Cl.[6] ..... A47B 3/06

[52] U.S. Cl. ..... 108/153; 108/150

[58] Field of Search ..... 108/150, 27, 153, 108/156, 157, 159; 248/158, 165, 163.1

[56] References Cited

U.S. PATENT DOCUMENTS

| | | | |
|---|---|---|---|
| 2,815,998 | 12/1957 | Jones et al. | 108/159 |
| 3,469,870 | 9/1969 | Barkus | 108/150 X |
| 3,521,579 | 7/1970 | Stafford | 108/153 X |
| 4,372,224 | 2/1983 | Ehrlich | 108/159 |
| 4,632,040 | 12/1986 | Sheffer | 108/159 X |
| 4,805,541 | 2/1989 | Drane et al. | 108/157 X |
| 5,318,260 | 7/1994 | Kemnintz | 108/153 X |

FOREIGN PATENT DOCUMENTS

| | | | |
|---|---|---|---|
| 4234475 | 4/1994 | Germany | 108/150 |

*Primary Examiner*—Jose V. Chen

*Attorney, Agent, or Firm*—McAulay Fisher Nissen Goldberg & Kiel

[57] ABSTRACT

The leg assembly for the outdoor trestle table is formed of a cross-piece unit and a pair of leg units. A pair of vertically spaced spacers at each end of the cross-piece unit slide into and fit within a pair of vertically disposed inverted L-shaped slots in a mounting plate secured to and extending from each leg unit. The cross-piece unit is mounted on the mounting plate of each leg unit without the need for tools and may be readily removed for storage purposes. The mounting plate has an H-shaped cross section which fits between two vertical portions of the legs in each leg unit to enhance stability of the mounting plate.

25 Claims, 5 Drawing Sheets

FIG. 3
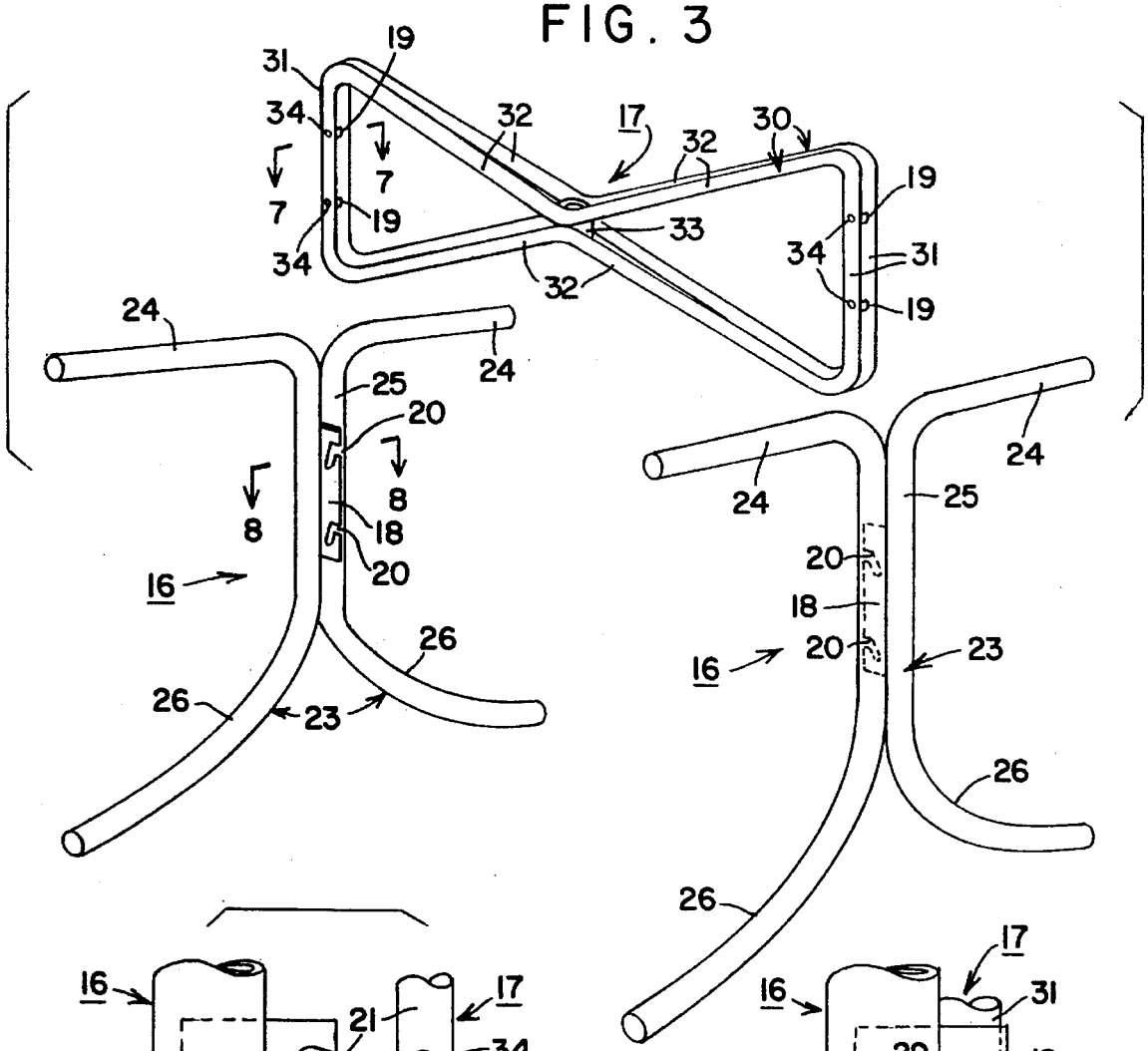
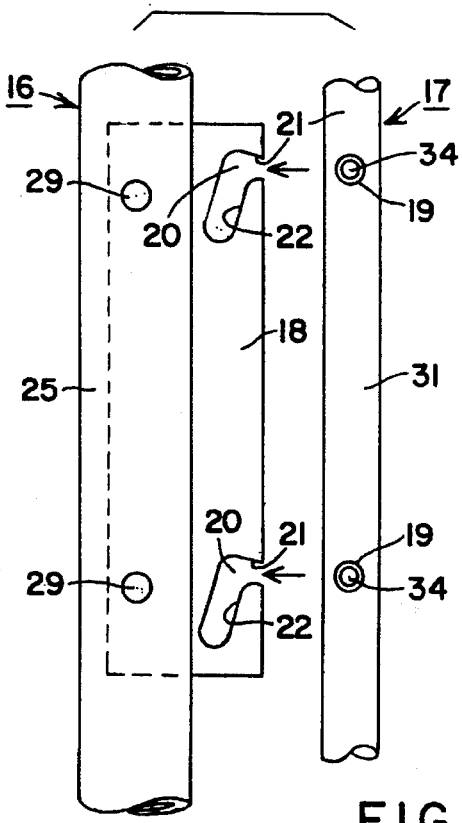
FIG. 4
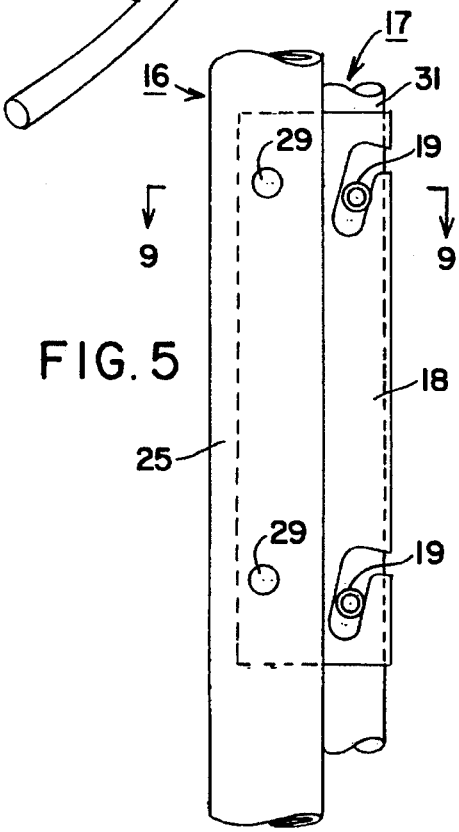
FIG. 5

FIG. 6
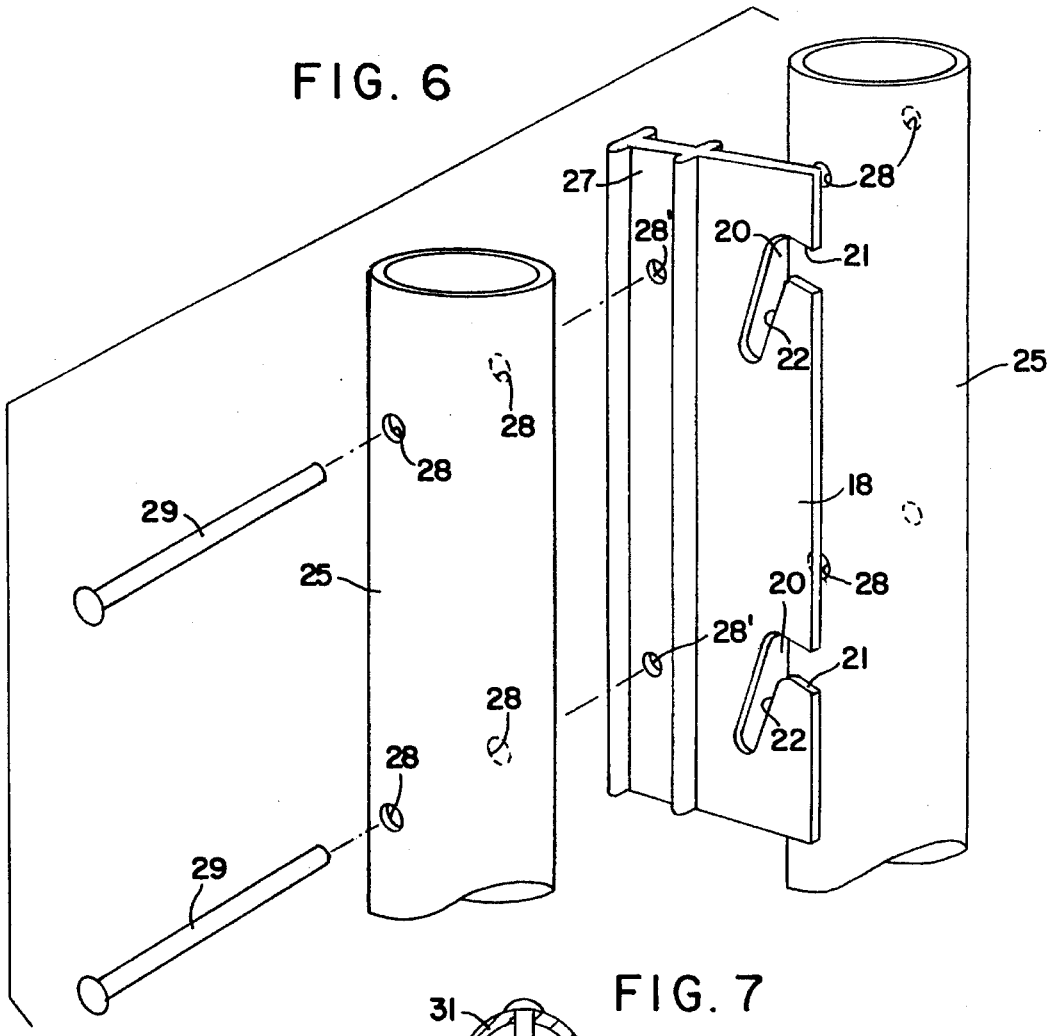
FIG. 7
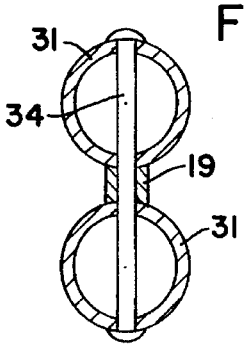
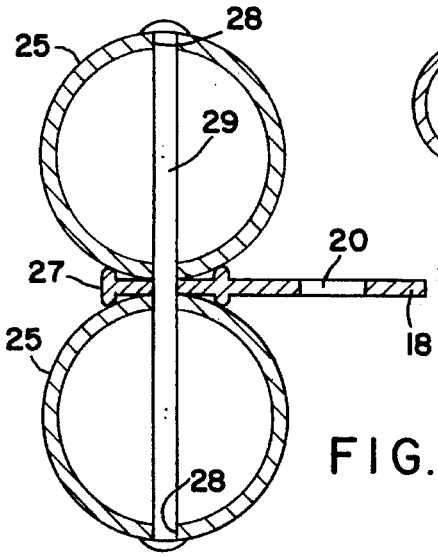
FIG. 8
FIG. 9
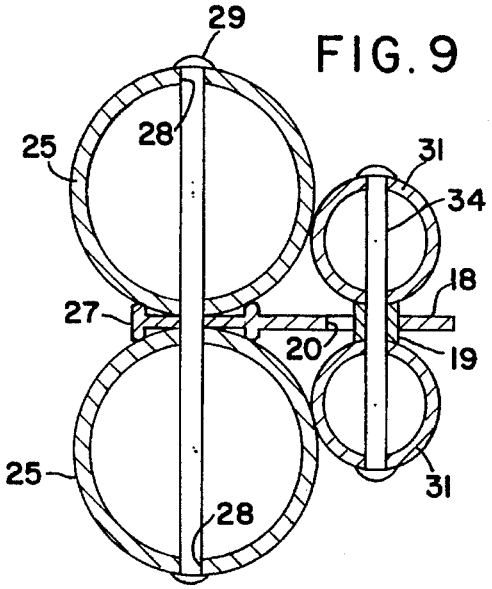

TRESTLE TABLE

This invention relates to a trestle table. More particularly, this invention relates to a leg assembly for a table. Still more particularly, this invention relates to a knock-down leg assembly for an outdoor table.

As is known, various types of table constructions have been employed for outdoor use wherein a table top can be disconnected from a leg assembly for shipping and/or storage purposes. For example, many types of outdoor tables have been constructed so that a table top can be readily removed from a leg assembly and the leg assembly thereafter disassembled into smaller pieces for storage purposes. In many cases, the table constructions have been made so that the tables can be assembled and/or disassembled without the need for tools.

One known outdoor table construction has utilized a leg assembly formed of two leg units which can be interfitted in crossing relation to each other so as to provide a support surface for a table top, typically of round shape.

Another known outdoor table construction has employed a leg assembly formed of a pair of spaced apart leg units and a horizontal cross-piece which is secured to and between the leg units by means of screws so as to form an integrated unit and to which a table top of rectangular or oval shape can be fitted. However, in this construction, the leg assembly has been relatively bulky to handle for storage purposes. While the cross-piece may be removed from the leg units by unthreading of the screws which hold the leg units and cross-piece together, this requires the use of tools and has the possibility that the screws may become lost prior to the next assembly date.

Accordingly, it is an object of the invention to provide a leg assembly for an outdoor trestle table which uses components of relatively simple compact construction which can be interconnected together in a simple tool-free manner.

It is another object of the invention to provide an outdoor trestle table which can be separated into individual compact components which in turn, can be readily transported and stored in a minimum of space without the need for tools.

It is another object of the invention to provide an aesthetically pleasing table which can be knocked-down into relatively simple flat components for storage purposes.

Briefly, the invention provides an outdoor table, for example of the trestle-type, which is comprised of a table top, a pair of leg units which removably support the table top, a cross piece which is disposed transversely between the leg units and means slidably connecting the cross piece unit at each end to a respective leg unit.

Each leg unit is constructed of a pair of tubular U-shaped legs which are disposed in co-planar relation perpendicularly of the cross piece unit. Each leg includes a horizontal upper portion to support the table top, a vertical portion and a lower portion to support the table on a flat surface.

The cross-piece unit includes a pair of parallel spaced apart cross-pieces and spacer means connected to and located centrally of the cross pieces for passage of an umbrella shaft. In this embodiment, the table top would be provided with a opening vertically aligned with the spacer means for passage of the umbrella shaft.

The means for slidably connecting the cross-piece unit to a respective leg unit includes a vertically disposed mounting plate with slots on one of the units and spacers in the other of the units received in the slots. Each mounting plate has a pair of slots with each slot having an entrance portion and a vertically directed portion extending from the entrance portion to receive a pair of spacers in slide-fit relation.

In one embodiment, a mounting plate is secured between the vertical portions of the legs of each leg unit while two spacers are secured between each of the cross-pieces of the cross-piece unit at each end. Further, in this embodiment, the vertically directed portion of each slot is directed downwardly and is angularly disposed to a vertical plane. Thus, when the cross-piece unit is being put into place, the spacers at each end of the cross piece unit enter through the entrance portion of the respective slots in the mounting plate and, thereafter, move downwardly into the angularly disposed vertical portions of the slots with an increasing friction fit. Thus, the weight of the cross-piece unit serves to increase the friction fit of the connection.

In one embodiment, the cross-piece unit is made of a pair of skeletal bow-tie shaped tubular cross-pieces. In this regard, each cross-piece is formed as an endless loop with the central portions "pinched in" and secured to each other as by welding. Such a construction forms a particularly rigid cross-piece unit.

In another embodiment, the cross-piece unit is composed of a pair of inverted U-shaped tubular cross-pieces. In addition, pairs of struts are connected to each cross-piece as by welding with each strut connected to and between a vertical portion of the cross-piece and a horizontal portion thereof in order to rigidify the cross-piece. The struts of each cross-piece are also secured together as by welding at a common point. The struts may also be provided with an ascetic appearance, such as being curved.

These and other objects and advantages of the invention will become more apparent from the following detailed description taken in conjunction with the accompanying drawings wherein:

FIG. 3 illustrates an exploded view of a leg assembly of the table of FIG. 1;

FIG. 4 illustrates a view of one end of a cross-piece unit relative to a leg unit during assembly;

FIG. 5 illustrates a view similar to FIG. 4 of one end of a cross-piece unit secured in place to a leg unit by a connecting means in accordance with the invention;

FIG. 6 illustrates an exploded view of a portion of a leg unit to which the mounting plate of the connecting means is secured in accordance with the invention;

FIG. 7 illustrates a view taken on line 7—7 of FIG. 3 of one end of a cross-piece;

FIG. 8 illustrates a view taken on line 8—8 of FIG. 3 of a central part of a leg unit;

FIG. 9 illustrates a view taken on line 9—9 of FIG. 5 of the connection of the cross-piece to a leg unit;

Figure 1:
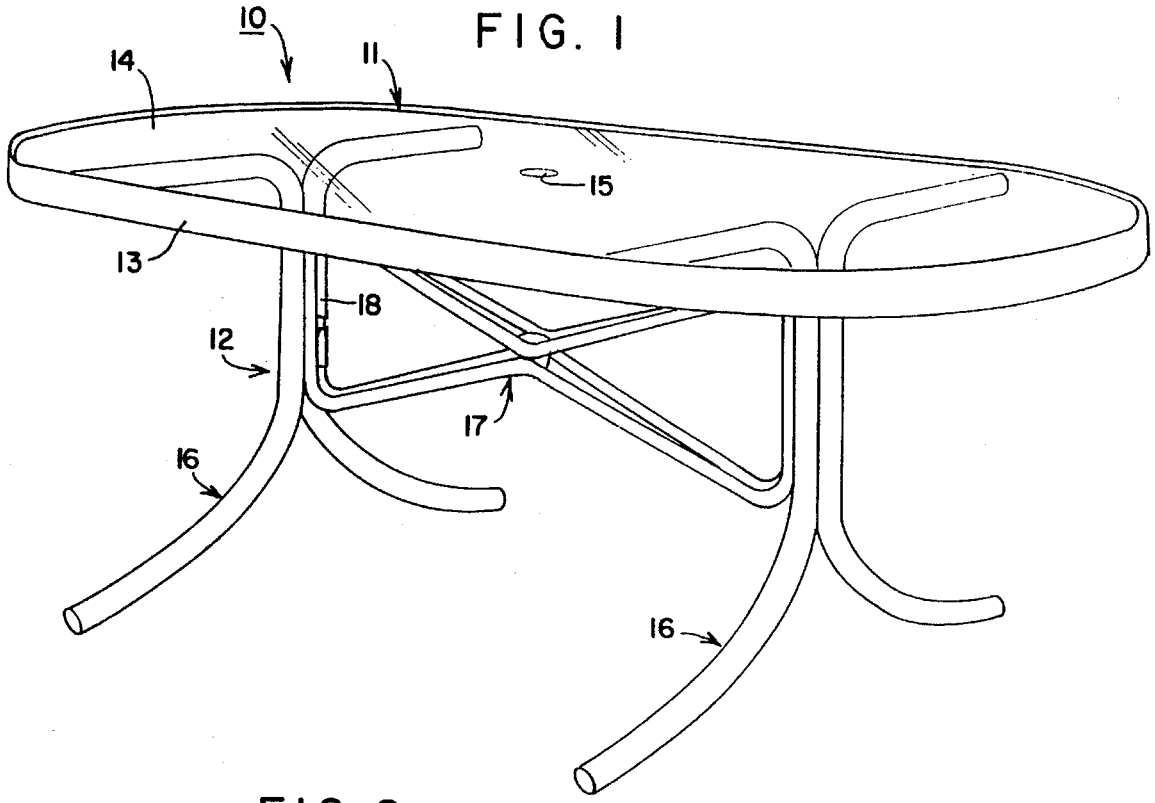
FIG. 1 illustrates a perspective view of an outdoor trestle table constructed in accordance with the invention.

Referring to FIG. 1, the table 10 is of trestle table type and includes a table top 11 and a leg assembly 12.

The table top 11 is of generally rectangular or elongated-oval shape and includes a rim 13 typically of extruded aluminum of predetermined shape and a table surface 14, typically of a clear plastic, such as acrylic. In addition, the table top 11 may have an aperture 15 at a centrally located point, for example for receiving a shaft of an umbrella (not shown).

Referring to FIGS. 1 and 3, the leg assembly 12 is comprised of a pair of spaced apart leg units 16 and a cross-piece unit 17 disposed transversely of the leg units 16. In addition, a means is provided for slidably connecting each end of the cross-piece unit 17 to a respective leg unit 16. This connecting means includes a vertically disposed mounting plate 18 on and projecting perpendicularly from each leg unit 16 and a pair of spacers 19 on the cross-piece unit 17. As indicated in FIG. 3, each mounting plate 18 has a pair of slots 20 therein with each slot 20 having an entrance portion 21 (see FIG. 4) and a vertically directed portion 22 extending downwardly from the entrance portion 21. As shown in FIGS. 4 and 5, each slot 20 is of inverted L-shaped with the vertically directed portion 22 disposed angularly of a vertical plane. The spacers 19 on the cross-piece unit 17 are sized and spaced apart so as to pass through the entrance portion 21 of the respective slots 21 (as indicated in FIG. 4) and to thereafter descend within the vertically directed portions 22 of the slots 20 (as indicated in FIG. 5).

Referring to FIG. 3, each leg unit 16 includes a pair of tubular U-shaped metal legs 23 disposed perpendicularly of the cross-piece unit 17. As indicated, each leg 23 has a horizontal top portion 24 for supporting the table top 11 thereon, a vertical portion 25 and a curvilinear bottom portion 26 for supporting the table 10 on a floor.

Referring to FIG. 6, each mounting plate 18 has a vertical portion 27 of H-shaped cross-section which is disposed between the vertical portions 25 of the legs 23 of a leg unit 16. In addition, the vertical portion 25 of each leg 23 is provided with two pairs of aligned apertures 28 which are aligned with apertures 28 in the mounting plate 18 for passage of a pair of headed rivets 29 therethrough. The pair of rivets 29 serve to secure the legs 23 of the leg unit 16 together while also securing the mounting plate 18 in fixed relation between the vertical portions 25 of the legs 23.

As indicated in FIG. 8, the H-shaped portion 27 of each mounting plate 18 serves to increase the surface area of contact between the respective leg portions 25 and the mounting plate 18 while also avoiding rolling of the tubular leg portions 25 relative to the flat surfaces of the mounting plate 18.

During assembly, the headed rivets 29 are passed through the apertures 28, 28 of the aligned leg units 23 and mounting plate 18 and deformed at the free end in known fashion so as to form a fixed permanent connection between the mounting plate 18 and the legs 23.

Figure 2:
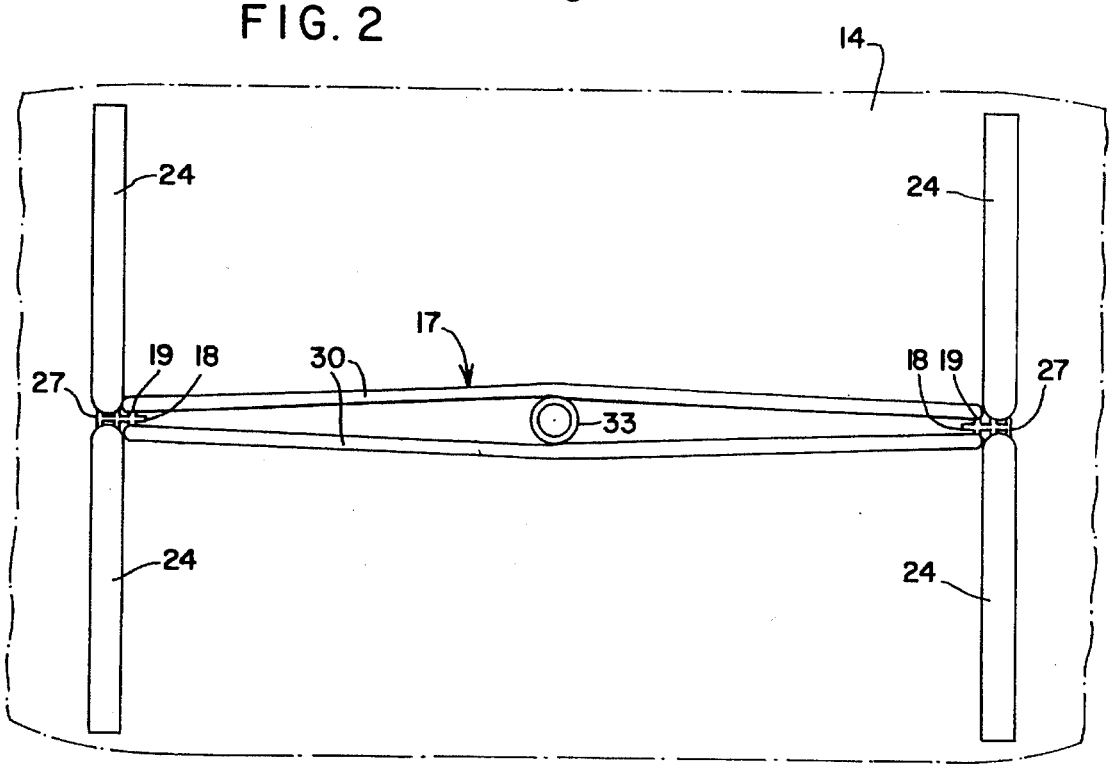
FIG. 2 illustrates a top view of a portion of the table of FIG. 1.

Referring to FIGS. 1, 2 and 3, the cross-piece unit 17 is formed in an integrated manner of a pair of skeletal bow-tie shaped tubular metal cross pieces 30. As indicated in FIG. 3, each cross-piece 30 is formed in an endless loop having a pair of vertically disposed end portions 31 and inclined intermediate portions 32. As shown, the intermediate portions 32 come together in a "pinched in" relationship and are welded together at a common juncture to form a rigid cross-piece.

The cross-piece unit 17 also includes a spacer means in the form of a tubular sleeve 33 which is connected to and located centrally of the cross-pieces 30 for passage of an umbrella shaft therethrough. For example, the sleeve 33 is welded to the respective inclined portions 32 of the cross-pieces 30.

The spacers 19 of the connecting means are located between the end portions 31 of the cross-pieces 30 and a pair of rivets 34 are provided for securing the cross-pieces 30 and the spacers 19 together. In this regard, as indicated in FIGS. 7 and 9, each rivet 34 passes through suitable apertures in the vertical portions 31 of the cross-pieces 30 as well as through a central bore of a spacers 19.

In order to assemble the table 10, the cross-piece unit 17 is fitted to the two leg units 16 in a slide-fit relation without the use of tools. For example, as indicated in FIG. 4, with a leg unit 16 in an upright vertical manner, one end of the cross-piece unit 17 is moved into alignment with the mounting plate 18. In this respect, the spacers 19 on the end of the cross-piece unit 17 are aligned with the entrance portions 21 on the slots 20 in the mounting plate 18. The end of the cross-piece unit 17 is then moved toward the leg unit 16 so that the spacers 19 move into the depending vertical portions of the slots 20. The weight of the cross-piece unit 17 then causes the spacers 19 to descend within the vertical portions 22 of the slots 20 to take up positions as shown in FIG. 5. The opposite end of the cross-piece unit 17 is then connected to the opposite leg unit 16 in a similar fashion.

With the cross-piece unit 17 secured between the leg units 16, the table top 11 can be mounted in place. In this regard, the horizontal portions 24 of the leg unit 16 may be provided with a suitable mounting arrangement such as a spring biased end cap for engaging with the depending rim 13 of the table top 11. Alternatively, the free ends of the horizontal leg portions 24 may cooperate with table clips which are mounted in place on the rim 13 to secure the leg unit 16 in place relative to the table top 11. Any other suitable known means may also be used for securing the table top 11 to the leg assembly 12.

In order to disassemble the table 10,a reverse operation is followed.

The connecting means between the cross-piece unit 17 and the leg units 16 provides a relatively rigid construction. In this respect, each mounting plate 18 is rigidly secured by a pair of rivets 29 to and between the legs 23 of a leg unit 16 in a secure clamp-type manner. Further, the H-shaped cross section of the mounting plate 18 which is sandwiched between the tubular leg portions 25 provides an enhanced fixed connection which prevents turning or pivoting of the mounting plate 18 relative to the tubular leg portion 25. Further, the slide fit relationship between the spacers 19 on the cross-piece unit 17 and the inclined vertical portions 22 of the slots 20 in the mounting plates 18 provides for a tight-fit relation between the cross piece 17 and the leg units 16.

The two vertically spaced apart connecting points between each end of the cross-piece unit 17 and a leg unit 16 enhances the stability of the table 10 against longitudinal forces on the table top 11. Also, the bow-tie shape of the cross piece unit 17 enhances the rigidity of the cross piece unit 17 relative to longitudinal forces imposed upon the table top.

Figure 10:
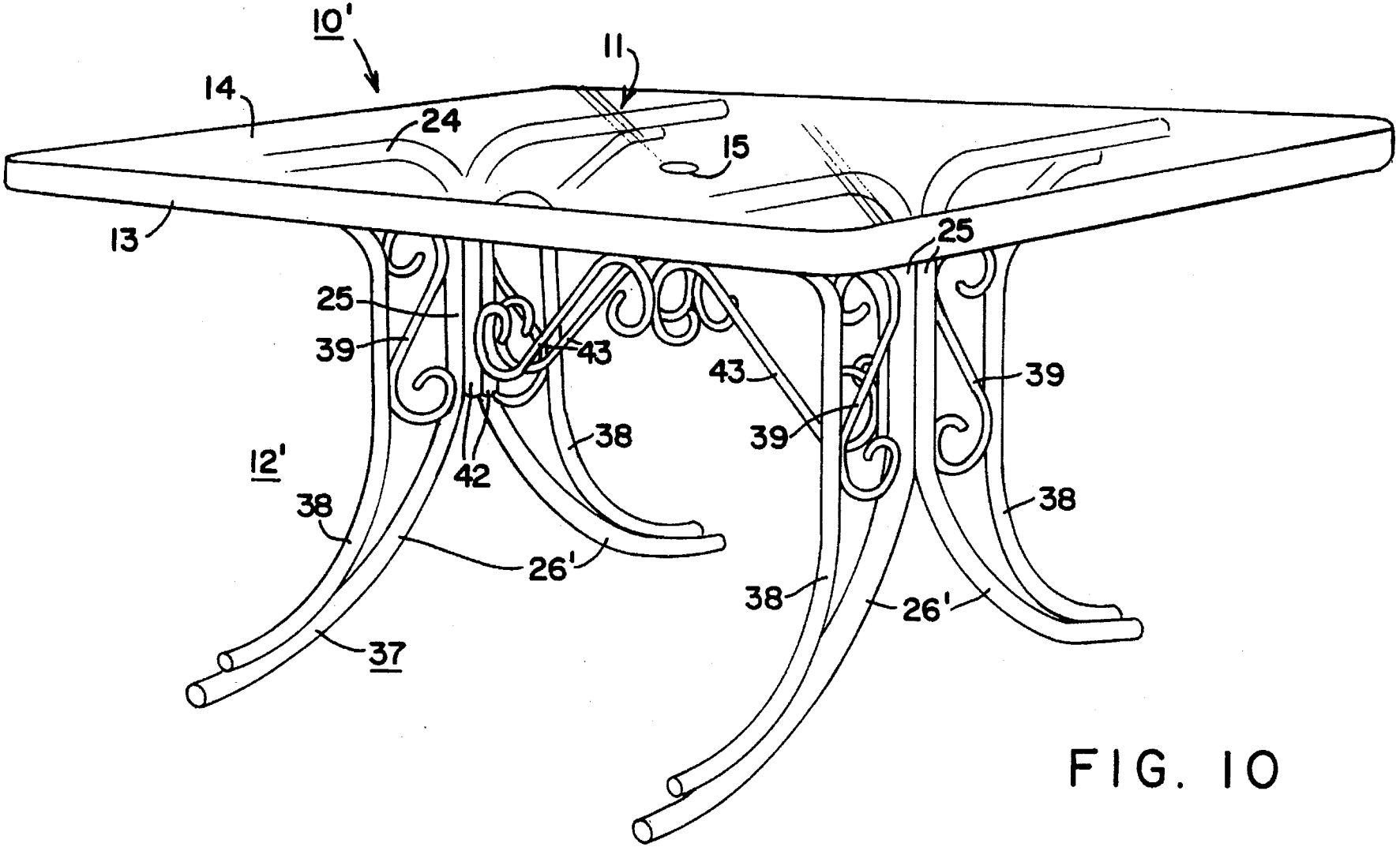
FIG. 10 illustrates a perspective view of a modified table constructed in accordance with the invention.

Referring to FIG. 10, wherein like reference characters indicate like parts as above, the table 10' may be constructed in a modified manner.

As shown in FIG. 10, the table top 11 may be of rectangular shape with a depending rim 13 and is mounted on a leg assembly 12' formed of a pair of leg units 35 and a cross-piece unit 36.

Each leg unit 35 is formed of a pair of U-shaped legs 37, each having a horizontal upper portion 24, a vertical portion 25 and a lower curvilinear portion 26' of more pronounced curvature than in FIG. 1. In addition, each leg unit 35 includes a U-shaped strut 38 secured to and within each leg 37 to rigidify the leg 37. A spacer 39 may also be secured between the strut 38 and the leg 37 for aesthetic purposes. For example, the spacer 39 is shown secured between the vertical portion 25 of each leg 37 and a similar vertical portion of the strut 38.

Figure 11:
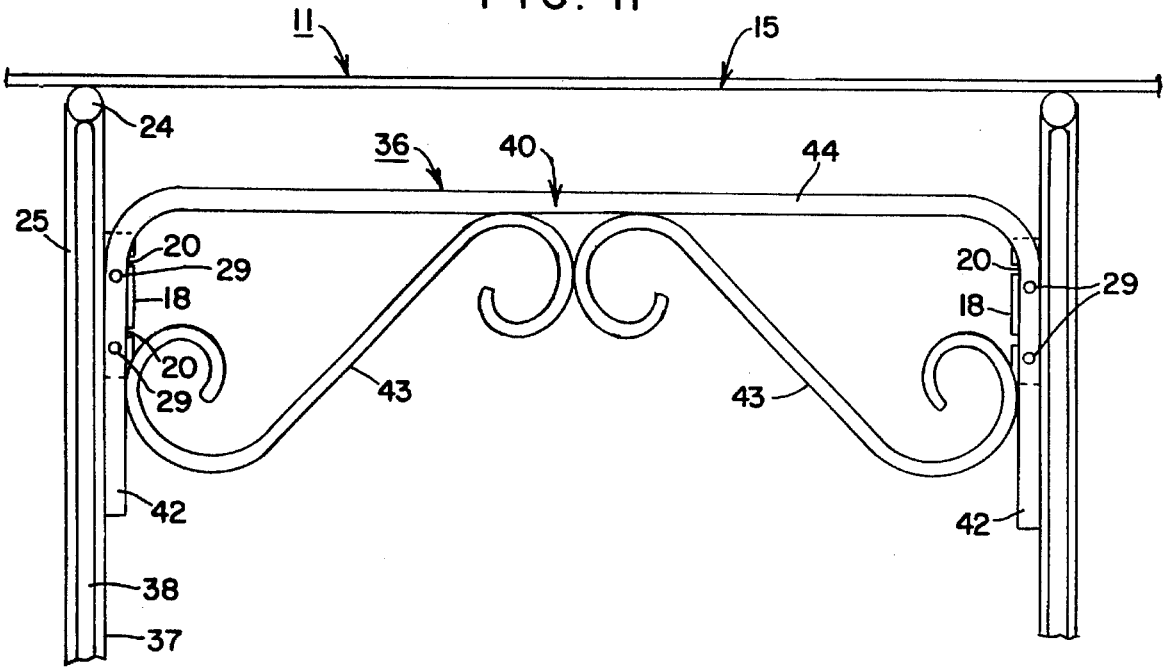
FIG. 11 illustrates a side view of the table of FIG. 10.
Figure 12:
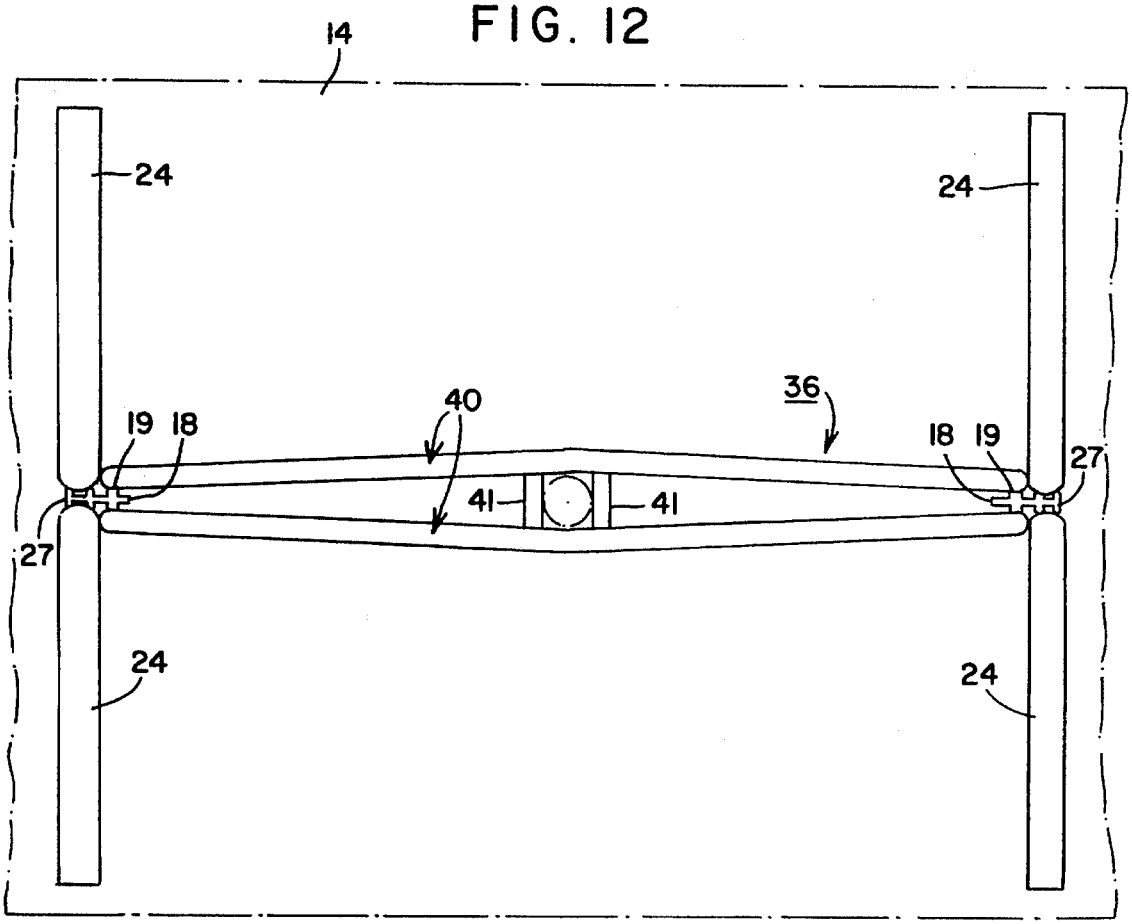
FIG. 12 illustrates a partial top view of the table of FIG. 10.

Referring to FIGS. 11 and 12, the cross-piece unit 36 is formed of a pair of parallel spaced apart cross-pieces 40, each of which is of inverted U-shape. In addition, as shown in FIG. 12, a spacer means in the form of a pair of spaced apart rods 41 are secured perpendicularly to and between the cross-pieces 40 at a central location in order to provide an opening for passage of an umbrella shaft. As indicated in FIG. 12, the spacer rods 41 also serve to space the cross-pieces 40 farther apart at the center than at the ends. As above, spacers 19 of the connecting means are provided between the vertical portions 42 of the cross-pieces 40.

As indicated in FIGS. 11 and 12, a mounting plate 18, as above, is connected to and between the vertical portions 25 of each leg 37 of a leg unit 35 to receive the spacers 19 which are connected between the vertical portions 42 of the cross-pieces 40 of the integral cross-piece unit 36.

As shown in FIG. 11, the cross-piece unit 36 also includes pairs of struts 43 for each cross piece 40. As indicated, each strut 43 is of curvilinear shape at the ends and is connected thereat as by welding to and between one of the vertical portions 42 of a cross-piece 40 and a horizontal portion of the cross-piece 40 as well as to the adjacent strut 43. Each pair of struts 43 serves to rigidify the respective cross-piece 40. In addition, the curvilinear shape of the struts provides an aesthetically pleasing appearance.

The table 10' of FIG. 10 may be assembled and disassembled in a similar fashion as described above with respect to the table 10 of FIG. 1.

The invention thus provides a leg assembly as well as an outdoor trestle table which can be readily assembled and disassembled without the need for tools. Further, the invention provides a table which can be disassembled into flat-shaped units or components so as to take up a minimum of storage space.

The invention further provides an outdoor trestle table possessing very rigid characteristics, particularly, relative to forces imposed longitudinally of the table top, that is, in a direction parallel to the cross-piece unit.

What is claimed is:

1. A leg assembly for supporting a table top thereon, said leg assembly comprising a pair of spaced apart leg units, each leg unit having a vertically disposed mounting plate located centrally thereof, said mounting plate having a pair of vertically spaced slots therein with each slot having an entrance portion and a depending portion extending from said entrance portion; and a cross-piece unit disposed transversely between and removably connected to said leg units, said cross-piece unit having a pair of parallel vertical portions at each end and a pair of spacers spacing said vertical portions apart at each said end, each pair of vertical portions receiving said mounting plate of a respective leg unit therebetween with said spacers disposed in said slots of a respective mounting plate.

2. A leg assembly a set forth in claim 1 wherein each slot is of inverted L-shape.

3. A leg assembly as set forth in claim 2 wherein said depending portion of each slot is angularly disposed relative to a vertical plane.

4. A leg assembly as set forth in claim 1 wherein each leg unit includes a pair of tubular U-shaped legs disposed perpendicularly of said mounting plate thereof.

5. A leg assembly as set forth in claim 4 wherein each mounting plate has a vertical portion of H-shaped cross-section disposed between said tubular legs of a respective leg unit.

6. A leg assembly as set forth in claim 5 which further comprises a pair of rivets passing through and connecting said tubular legs of a respective leg unit and said H-shaped vertical portion of said mounting plate disposed therebetween.

7. A leg assembly as set forth in claim 4 wherein each leg unit further includes a U-shaped strut secured to and within each U-shaped leg to rigidify said U-shaped leg.

8. A leg assembly as set forth in claim 4 wherein each U-shaped leg has a horizontal portion for supporting a table top thereon.

9. A leg assembly as set forth in claim 1 wherein said cross-piece unit includes a pair of parallel spaced apart cross-pieces.

10. A leg assembly as set forth in claim 9 wherein said cross-piece unit includes a spacer means connected to and located centrally of said cross-pieces for passage of an umbrella shaft.

11. A leg assembly as set forth in claim 10 wherein said spacer means is a sleeve.

12. A leg assembly as set forth in claim 10 wherein said spacer means is a pair of spaced apart rods secured perpendicularly to and between said cross-pieces.

13. A leg assembly as set forth in claim 9 wherein each said cross-piece is of skeletal bow-tie shape.

14. A leg assembly as set forth in claim 9 wherein each said cross-piece is of inverted U-shape.

15. A leg assembly as set forth in claim 14 wherein said cross-piece unit includes two pairs of struts, each strut being connected to one of said vertical portions of a respective cross-piece, a horizontal portion of said respective cross-piece and to an adjacent strut to rigidify said respective cross-piece.

16. A trestle table comprising a table top;

a pair of leg units removably supporting said table top thereon;

a cross-piece unit disposed transversely between said leg units; and means slidably connecting said cross-piece unit at each end thereof to a respective leg unit, said means including a vertically disposed mounting plate on and projecting perpendicularly from one of said leg unit and said cross-piece unit and having a pair of slots therein with each slot having an entrance portion and a vertically directed portion extending from said entrance portion, and a pair of spacers on the other of said leg unit and said cross-piece unit removably received in said slots of said mounting plate in slide-fit relation.

17. A table as set forth in claim 16 wherein each leg unit includes a pair of tubular U-shaped legs disposed in co-planer relation perpendicularly of said cross-piece unit.

18. A table as set forth in claim 17 wherein said cross-piece unit includes a pair of spaced apart cross-pieces and spacer means connected to and located centrally of said cross-pieces for passage of an umbrella shaft.

19. A table as set forth in claim 18 wherein each said cross-piece is of bow-tie shape.

20. A table as set forth in claim 18 wherein each said spacer means is a pair of spaced apart rods secured perpendicularly to and between said cross pieces.

21. A table as set forth in claim 18 wherein said means includes a vertically disposed mounting plate on one of respective said leg unit and said cross-piece unit and having a pair of slots therein with each slot having an entrance portion and a vertically directed portion extending from said entrance portion, and a pair of spacers on the other of a respective said leg unit and said cross-piece unit removably received in said slots of said mounting plate in slide-fit relation.

22. A table a set forth in claim 21 wherein said mounting plate is secured between said tubular U-shaped legs of a respective leg frame and said spacers are secured between said cross-pieces of said cross-piece unit.

23. A table as set forth in claim 16 wherein each leg unit includes a pair of tubular legs disposed perpendicularly of said cross-piece unit and having said mounting plate secured therebetween and said cross-piece unit includes a pair of parallel spaced apart cross-pieces with said spacers secured therebetween.

24. A table as set forth in claim 23 wherein said vertically directed portion of each slot is angularly disposed to a vertical plane.

25. A trestle table comprising a table top;

a pair of leg units removably supporting said table top thereon, each leg unit including a pair of tubular U-shaped legs disposed in co-planer relation;

a cross-piece unit disposed transversely between said leg units, said cross-piece unit including a pair of spaced apart cross-pieces and a pair of spaced apart rods connected perpendicularly to and located centrally of said cross-pieces for passage of an umbrella shaft; and means slidably connecting said cross-piece unit at each end thereof to a respective leg unit.

* * * * *

UNITED STATES PATENT AND TRADEMARK OFFICE

CERTIFICATE OF CORRECTION

PATENT NO. : 5,499,585

DATED : March 19, 1996

INVENTOR(S) : Robert D. Vanderminden

It is certified that error appears in the above-identified patent and that said Letters Patent is hereby corrected as shown below:

On the title page, item [22]:

change "May 27, 1994" to -June 27, 1994-

Signed and Sealed this

Fifteenth Day of February, 2000

*Attest:*

Q. TODD DICKINSON

*Attesting Officer*

*Commissioner of Patents and Trademarks*